US009077080B1

(12) United States Patent
Josypenko

(10) Patent No.: US 9,077,080 B1
(45) Date of Patent: Jul. 7, 2015

(54) INDUCTIVELY SHORTED BICONE FED TAPERED DIPOLE ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 486 days.

(21) Appl. No.: 13/478,355

(22) Filed: May 23, 2012

(51) Int. Cl.
*H01Q 13/04* (2006.01)
*H01Q 13/06* (2006.01)
*H01Q 9/28* (2006.01)

(52) U.S. Cl.
CPC ..... *H01Q 13/04* (2013.01); *H01Q 13/06* (2013.01); *H01Q 9/28* (2013.01)

(58) Field of Classification Search
CPC ..... H01Q 13/04; H01Q 13/06; H01Q 9/28
USPC ..... 343/807, 773, 774
See application file for complete search history.

(56) References Cited

U.S. PATENT DOCUMENTS

| | | | | |
|---|---|---|---|---|
| 6,667,721 | B1 * | 12/2003 | Simonds | 343/773 |
| 8,487,824 | B1 * | 7/2013 | Josypenko | 343/807 |
| 2012/0044119 | A1 * | 2/2012 | Libonati et al. | 343/807 |

* cited by examiner

*Primary Examiner* — Michael C Wimer
*Assistant Examiner* — Michael Bouizza
(74) *Attorney, Agent, or Firm* — James M. Kasischke; Jean-Paul A. Nasser; Michael P. Stanley

(57) ABSTRACT

An antenna for passing a cable to a second antenna includes shorts positioned along a circumferential perimeter of the antenna, first and second bicone sections of oppositely directed conductive cone sections energized at respective apices and opening along an antenna axis, first and second dipole sections, where the first dipole section is joined together with and extending from the first conical section to the circumferential perimeter of the antenna, and where the second dipole section is joined together with and extending from the second conical section to the circumferential perimeter of the antenna.

19 Claims, 12 Drawing Sheets

INDUCTIVELY SHORTED BICONE FED TAPERED DIPOLE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The invention generally relates to RF antennas and more specifically to bicone and dipole antennas.

(2) Description of the Prior Art

Resonant Antennas

Antennas that have two or more relatively isolated paths from their feed points to their ends, on two or more dimensions of a structure, or have two or more relatively isolated or independent elements, can have a resonance associated with each path or element. For example, the elements of one of the bifilar helixes of the quadrifilar helix described in U.S. Pat. No. 5,138,331 (herein incorporated by reference in its entirety for background information only), are an example of two or more relatively isolated elements.

If the resonances are adjacent to each other in frequency, they can combine to form a resonance/anti-resonance impedance loop with a bandwidth formed of the overlapping bands of both resonances. The overlapping bands can be formed in one of several ways. In one way, the feed points of two resonant elements can be feed in parallel, which results in an input impedance that is the parallel combination of the impedances of each element, where ideally the elements are fully isolated from each other. A resonance/antiresonance loop can form between the two resonant frequencies.

Infinite isolation occurs if the elements are separated by infinite distance, or if each element occupies its own dimension independent and located 90 degrees from other occupied dimensions. When elements are closer together, coupling between them occurs and bandwidth loss from the increase in the magnitude of the reflection coefficient (about the antenna characteristic impedance $Z_0$) is possible. Much tighter spacing and coupling can also change reflection coefficient phase and impedance locus shape.

As an example, the elements of one of the bifilar helixes of the antenna of U.S. Pat. No. 5,138,331 were very tightly spaced at approximately 0.02 wavelength separation, because of space constraints. Also the configuration did not allow a second element to be rotated 90 degrees away into another dimension from a first element. Thus, the elements were tightly coupled to each other. This initially introduced a large Voltage Standing Wave Ratio (VSWR) spike in the band overlap area between any two resonance frequencies of any two adjacent elements fed in parallel, caused by a non-radiating transmission line formed between the elements. In the overlap area, the shorter element with a resonance frequency above the area has a capacitive impedance of negative phase approaching −90 degrees. The longer element with a resonance frequency below the area has an inductive impedance of positive phase approaching 90 degrees. The resultant phase difference approaches the 180 degrees of a transmission line.

To rid the transmission line and spike, a feed phase difference of 180 degrees was introduced between the elements, to bring the approaching 180 degrees phase difference to approaching 0 degrees. In the areas of the resonances and their overlapping, the resultant impedance still had some loss of bandwidth from an increased reflection coefficient magnitude (about the antenna characteristic impedance $Z_0$), when compared to the calculated parallel combination of the measured impedances of each element by themselves.

Another way overlapping bands can be formed is as follows. One resonant element can be fed with coupling to other parasitic elements resonant at adjacent frequencies. The impedance locus becomes that of the fed element, with the parasitic elements inserting resonance/antiresonance loops in the locus near the parasites' resonance frequencies, for an increase of bandwidth. This is further explained in the background in U.S. Pat. No. 6,118,406.

Another way overlapping bands can be formed is as follows. A parallel combined impedance resonance/antiresonance loop can result from the resonances of two or more paths on two or more independent 90 degree (referenced to a feed point) separated dimensions of an antenna of simple shape. This type of impedance is more complex, such as with the location of the resonance frequencies, because the parts of the antenna in each dimension are not fully isolated from each other. From the feed point, currents are not necessarily restricted from flowing only along the direction of the dimensions, but can flow also along paths between the dimensions. For example, for a flat rectangle dipole, currents can flow not only along the direction of the independent dimensions of length and width, but along a diagonal between these dimensions, from the feed point to a corner on the open end of the rectangle.

Ninety degrees of separation allows maximum isolation. However, antennas with geometries of maximum separations of less the 90 degrees can still have a resonance for the length at each extreme of the separation, but there will be less isolation and independence between each resonance, and less bandwidth. For example, the flared edges of a flat bicone with a flare angle of less than 90 degrees can be made with asymmetrical lengths. In the extreme case of 0 degrees of separation, there is only one dimension of one length, and thus only one possible resonance.

In general, a certain amount of electrical distance must exist between two paths for each path to be able to be a distinct resonant path. For paths along independent dimensions, this is afforded simply by the physical 90 degree separation between two paths. However, enough electrical separation between paths physically separated by less than 90 degrees also allows distinct resonant paths. This results in the fact that in general for a continuous structure, more resonant paths can exist on the structure as frequency is increased.

As frequency is increased, an initially resonant basic antenna tends to lose its resonant behavior as it becomes more broadband from the following factors:

a. resonant paths become wider and thus more broadband;
b. more paths become available from increased available electrical separation; There can be more different resonant lengths leading to more broadband behavior;
c. the antenna can start to become a traveling wave antenna from increased path lengths and from the condition where most of the energy applied at the feed point has radiated by the time it reaches the end of the antenna.

Reflection coefficient and VSWR FIGS. 5 and 6 shows in more detail how ideally an overlapping band can be formed, using an example of a case of parallel combination of two ideal resonant bands of narrow bandwidth. Traces 301, 401 shows an ideal single ¼ wavelength resonance at 305, 405 plotted versus electrical length over the range of 0 to ½ wavelengths, and is representative of a simple open ¼ wavelength antenna element. It was generated by taking a 0.9 magnitude reflection coefficient circle and changing its normalized characteristic impedance $Z_0$ so that the point where it crosses the real axis of the Smith Chart at its resonant point would lie at the center of the Smith Chart. The rest of the traces show the resultant impedance when the impedances of two such resonance traces are combined in parallel, with increasing degrees of difference of their resonance frequencies and band centers, in terms of differences in their electrical length. The electrical length shown is the average of lengths of both traces. Traces 302, 402 show the case when both resonant frequencies coincide, with a difference in electrical length of 0. Although the VSWR traces show an apparent increase in bandwidth, there is no difference in bandwidth. The apparent increase is due to a halving of the impedance with a resultant detuned VSWR, both due to the parallel method of combining the impedances. With a parasitic combination, this would not occur. Traces 303, 403 show a slight 0.0125 electrical length difference in resonances, with resonant points 306, 406 and 307, 407. Some increase in bandwidth is seen and a small, tight dip 311 in the shape of a V is seen in the impedance locus. Traces 304, 404 show a case of further separation of 0.025 at resonant points 308, 408 and 309, 409. More increase in bandwidth is seen, but with a rise in VSWR starting to occur at the center of the band. The tip of the V has started to form into a less tight resonance/antiresonance loop 312, with a spreading out of the locus. The apparent center of the two bands of the two resonances start to appear at 410 and 411, but the actual centers are at 408 and 409 (308 and 309 on the Smith Chart). The difference is due to the impedance combination mechanism and selection of the Smith Chart characteristic impedance. Further separation of the resonance frequencies would push the bands further apart, with a large VSWR occurring between the bands, and an increase in the size of the resonance/antiresonance loop. From another viewpoint, as the bandwidths of two adjacent resonances increases, there is more overlapping of bands, with the resonance/antiresonance loop of the overlapping area decreasing in size, from an example loop 312 of trace 304 to the indented V 311 of trace 303 to disappearing almost to a single spot on a trace similar to point 305 on trace 302. A large frequency range of the impedance locus would appear almost at a single point on the Smith Chart. Overall, larger resonant bands would allow larger combined bands.

For larger bands to be matched, more than two resonances such as for example from more than two resonant elements are used, with all element resonance frequencies staggered side-by-side across the band and all elements fed in parallel. For any given frequency in the band, only one element is radiating at resonance at low impedance or the areas near and between the adjacent resonances of two radiating elements are overlapping at low impedance. The resultant low impedance is only from these elements. All other elements are at high impedance with little effect on the resultant impedance, and with little radiation. Those resonant above the given frequency are shorter, with a high capacitive impedance; those resonant below the given frequency are longer with a high inductive impedance. For very large bands, all the elements will eventually radiate at their next higher order resonances, and thus the staggering of frequencies can continue with the frequencies of these resonances, subject to the patterns of these resonances and their resistive impedances being acceptable.

Ideally the resonance/antiresonance loop of any type of combination of adjacent resonances should be centered on the real axis of the Smith Chart. However, other variables of the antenna, such as the condition of dimensions and their associated resonances not being fully isolated from each other, or other components of capacitance, inductance, and delay reflective of the antenna geometry, can move and rotate the resonance impedances and resultant loop in the capacitive or inductive direction. For dimensional resonances, their frequency locations and combining can become complex, since continuous antenna elements have no distinct boundaries between the dimensions in which different sized pieces of an element can independently resonate. Also antenna shape largely determines locations of resonance paths.

The combination of two resonances of two largely different bandwidths can also cause the loop to be off of the real axis, where the narrow band resonance appears as a small loop almost anywhere in the impedance locus of the large band resonance. For example, a narrow band resonant length of a narrow feed cable feeding a broadband resonant fat dipole or broader band bicone antenna on its axis can insert a small resonance/antiresonance loop into the impedance locus of the antenna when the antenna is electrically small and of high impedance. For another example, slight irregularities such as asymmetries or cracks in an antenna can also create slightly different length narrow resonant paths that can add small loops anywhere in an antenna impedance.

Ideally the resonance/antiresonance loop should center about the feed $Z_0$, typically 50 ohms. For simple antennas composed of two elements that have a width and length, this can be done to varying extents by controlling the antenna characteristic impedance $Z_0$ where $Z_0$ is given by $$Z_0 = \sqrt{\frac{L}{C}}.$$

where C is capacitance per antenna element unit length and L is inductance per antenna element unit length. Wider or fatter antenna elements will increase capacitance between elements and reduce inductance along their lengths, and thus reduce $Z_0$.

Examples of two dimensional antennas whose dimensions can be at least roughly of resonant length are flat dipoles, the end fire slot, and the rectangular patch fed at the center of one of its edges. Even the three dimensional bicone fed dipole, discussed in detail later, can have two resonant dimensions, e.g. its diameter and its length from its feed point to its end, although usually the bicone aperture is open enough so that the impedance of the bicone part or diameter of the antenna is very broadband and almost nonresonant.

Inductively Shorted Bicone

A shorted bicone antenna 100 as illustrated in FIG. 3 includes a top cone 102, a bottom cone 104, a feed point 105 at a feed angle 106 between top cone 102 and bottom cone 104, a feed cable 107 to connect to feed point 105 and narrow inductive shorts 108 placed vertically across and connected to the outer edges 110, 112 of the cones of the antenna 100, allowing cables to pass the antenna vertically via the shorts. This allows other antennas to be mounted and fed above the shorted bicone. The effects of the shorts on the normal bicone are described below and in more detail in U.S. Pat. No. 6,268,834, herein incorporated by reference in its entirety for background information only.

The shorts somewhat increase the cut-in frequency of the bicone. The cut-in frequency is defined where and above which the voltage standing wave ratio (VSWR) about the antenna characteristic impedance $Z_0$ becomes low and flat for infinite bandwidth. To minimize this rise, the shorts are made as narrow as practically possible and their number is minimized.

At lower frequencies, from roughly 1500 MHz to 0 Hz, where the radial path 118, 122 for example from the feed point to center 124 for example of the shorts becomes small, the shorts wrap the Smith Chart impedance locus of the open antenna progressively an extra half turn counterclockwise to a short at 0 Hz, when the open antenna is fully shorted. At 0 Hz the locus is wrapped an entire half turn from an open to a short. At somewhat higher frequencies from 1000 to 1700 MHz, where the path is no longer small, an increase of the bandwidth of the antenna occurs, from a significant tightening of the impedance locus in the shape of a shallow V. The tip of the V has a tiny loop at around 1100 MHz to 1300 MHz. This can be seen in the impedances of the antenna before and after addition of the shorts as shown in FIGS. 4A and 4B in U.S. Pat. No. 6,268,834. At higher frequencies above 2000 MHz, there is little difference in bandwidth with the addition of the shorts.

The V shaped part of the locus appears to be that of the V shaped part 311 of locus 303 of overlapping resonances of FIG. 5, except the resonances are separated slightly more which allows the resonance/antiresonance loop to form. The resonances can be from two different antenna parts or components.

The shorts force the antenna to have two parts: a shorted part and an open part. The shorted part consists of four shorted sections of roughly 45 degrees of circumference about the antenna axis 101 per section for half of the total circumference, with a short centered in each section. The open part consists four open sections between the shorted sections, of roughly 45 degrees of circumference about the antenna axis 101 per section for the other half of the circumference. The boundaries between the sections are not sharp but instead there is a smooth transition when moving circumferentially from one type of section to another. A section exists on both cones of the bicone, at the same circumferential positions on both cones. Half of a section on a given cone surface is pie shaped, extending from the feed point to the circumference of the antenna. An example of half of a shorted section is shown as the area 125 between radial lines 126, 127 and circumferential line 128.

The lengths of the open and shorted parts can be resonant. The length of the open part is the 2.74" of example radial path 114 from the feed point 105 to an open edge point 116 of the bicone between two shorts. The length of the shorted part is the 2.74" of the example radial path 118 from the feed point 105 to an end of a short at an open edge of the bicone at 120 and the length 1.37" of example path 122 from point 120 to the center 124 of the attached example short, for a total length of 4.11". If the resonant frequencies of the open and shorted lengths are adjacent, their bands can overlap and form the observed resultant V shaped part of the locus.

A given open end of the bicone and an adjacent shorted end are separated by 45 degrees of azimuth about the antenna axis, and thus there is at least some isolation between the two paths. With antennas with fewer shorts and wider sections, there is more isolation between the shorted and open parts, with more independence of the resonances.

Since a given part is half as wide in the circumferential direction as the original antenna's 360 degrees of circumference, its bandwidth can be expected to be roughly one half of the original antenna and be more resonant. The shorted part would have even less bandwidth because of the narrow band of its narrow shorts. The more resonant, narrower band impedances will change quicker with frequency than the very broadband resonances of the original bicone. Since the exact reduction in bandwidth of the parts is unknown, and since the parts are not fully isolated from each other, their exact resonance frequencies are unknown. However, at least the shorted resonance should be close to that of its path length, since the short itself is narrow and narrowband.

The following table shows what the resonant frequencies of the part lengths would be if they are narrow band, and any resonance/antiresonance loops between these frequencies observed in the impedance of the antenna in FIG. 4B. In parenthesis are the resonances of the original bicone. The V overlap area between the first two resonances is the most noticeable, because just above cut in, where the antenna becomes well matched and broadband, the antenna is most narrowband where narrowband loops can form. At higher frequencies, it is difficult to see any band overlapping since the antenna is more broadband and resonances are broadened significantly. Thus overlapping would produce at most only clustering of frequencies in the overlap area of the impedance locus, and not any indentations or loops. The first two resonance frequencies of 1078 and 1437 MHz of respectively the open and shorted sections are approximately in the same positions relative to the V as are resonance frequencies 306, 307 of theoretical trace 303 of FIG. 5. If instead the open section resonance frequency is lower and closer to the original open bicone resonance frequency of 695 MHz, then the shorted resonance has combined with a section of the open section impedance that is somewhat higher in frequency than its resonance frequency.

TABLE 1

| Resonant frequency of path or center frequency of loop (MHz) | Path type and length (wavelengths) Open bicone path 114 | Shorted bicone path 118, 122 | Resonance/ antiresonance loop |
|---|---|---|---|
| 1078 (695) | .25 | | |
| 1200 | | V | indentation |
| 1437 | | .5 | |
| 2874 | | 1 | |
| 3233 (2900) | .75 | | |

Overall, a tightening of the impedance locus occurred which appears to be from a band overlapping mechanism on the antenna, provided by at least one resonance due to a shorted path occurring near a resonance of the open parts of the antenna.

The shorts physically provide a balun path across the radiation aperture of the antenna, so other cables to antennas mounted above the shorted bicone can pass the bicone without affecting its performance. At higher frequencies where the distance between adjacent shorts becomes an appreciable part of a wavelength, nulls start to form in the azimuth patterns about the shorts, and increase in depth with increasing frequency.

Bicone Fed Dipole

FIG. 4 illustrates a bicone fed dipole 200 with a bicone feed section 203 that includes a top cone 202, a bottom cone 204, a feed point 205 at a feed angle 206 between top cone 202 and bottom cone 204, and with dipole sections 208, 209 of diameter 218 and height 220. The bottom edge of dipole section 208 and the top edge of cone 202 join and share common edge 210; the top edge of dipole section 209 and the bottom edge of cone 204 join and share common edge 212. Fat dipoles are commonly fed with bicones at their feed region. This allows the feed point impedance to more gradually taper to that of the dipole. If instead the feed region is simply two closely spaced parallel radial plates at the starting edges 210, 212 of the dipole cylinders 208, 209, formed of cones 202, 204 when feed angle 206 becomes 0 degrees, then the plates form a large shunt, non-radiating capacitance at the feed point 205 and across the resultant small gap between the flattened cone plates 202, 204 which decreases the impedance and the bandwidth of the antenna.

The bicone can help prevent the pattern splitting of a normal dipole. At lower frequencies, the bicone is small and radiates little and the antenna is thus a dipole composed of both the bicone and dipole sections, and having a dipole impedance radiating normal dipole patterns. Its whole length from the feed point 205 to the ends of the dipole sections 214, 216 radiates. This length is the whole length of radial dipole path 222 and 226 from feed point 205 to the end 228 of the dipole section, 208, and is also the length of the same path on the opposite cone section 204 and dipole section 209. At higher frequencies when a normal dipole is long enough (an approximately ¾ wavelengths path length) for elevation patterns to start to split on the horizon (the plane perpendicular to the antenna axis 201 at its feed point 205), if the bicone is large enough above its cut in frequency, it can start radiating a significant amount of the applied antenna power as its non-splitting bicone pattern. This radiation will help fill in the nulls of the dipole radiation. At even higher frequencies, by the time the wave introduced at the feed point reaches the end of the bicone at edges 210, 212, most of its power has been radiated before reaching the dipole sections 208, 209, and thus the antenna radiates patterns of a bicone, with an impedance mainly of the bicone by itself. Since a bicone with a small enough feed angle can maintain radiation on the horizon for a very large bandwidth, it can help stabilize the initial dipole patterns over a large bandwidth.

When the bicone is large, a significant part of the applied antenna power has radiated by the time the wave reaches the end 210, 212 of the bicone 202, 204 and the beginning 210, 212 of the dipole sections 208, 209. The impedance is mainly that of the bicone and any effects from the dipole sections 208, 209 is added to a bicone impedance. When the bicone is small, the whole antenna radiates with a dipole impedance, with its main effects being from the dipole sections 208, 209. These effects on the antenna impedance are described further below.

The addition of the dipole sections to the bicone gives the antenna two lengths that can possibly resonate or at least provide two bands. Radial path 222 from the feed point to the edge 210 of cone 202 at point 224 is the length of the bicone. This path plus its continuation as radial path 226 on the dipole section 208 to the end of the dipole section 214 at point 228 is a dipole length.

The details of the impedance behavior of a bicone fed dipole can be examined by looking at the impedance and VSWR (FIGS. 7, 8) of a sample bicone fed dipole of the following dimensions, as shown in FIG. 4:

TABLE 2

| Parameter | Value |
|---|---|
| Bicone feed angle 206 | 50 degrees |
| Antenna diameter 218 | 3.07" |
| Dipole section height 220 | 0", curves 501, 521 of FIGS. 7, 8<br>2", curves 502, 522 of FIGS. 7, 8 |
| Bicone radial path 222 length | 1.694" |

TABLE 2-continued

| Parameter | Value |
|---|---|
| Dipole section path 226 length 220 | 2" |
| Dipole path 222 + 226 length | 3.694" |
| Bicone radial path 222 length ¼ wavelength frequency 508, 510 | 1746 MHz |
| Dipole path 222 + 226 length ¼ wavelength frequency 509 | 799 MHz |

Traces 501 and 521 show the impedance and VSWR of the bicone 202, 204 of the antenna by itself. Above a VSWR=3:1 cut in frequency 503, it shows a very broad band, low VSWR area 505, 525 typical of bicones, where the impedance locus wraps tightly around an antenna characteristic impedance 506. As the dipole sections are started to be added to the bicone, a tightening of the locus in area 505 above 1700 MHz starts to occur. This is due to two radiating lengths with two very close adjacent bands: a broadband bicone length 222 along the radial direction, and a somewhat longer narrower band dipole length composed of the bicone length 222 and the length 226 of the added dipole section. As the length of the dipole section is increased, a resonance/antiresonance loop starts to form in the impedance locus, reflecting the ¼ wavelength length resonance frequency 509 of the dipole, in a way similar to the formation of the loop between the two parallel resonances of trace 304 in FIG. 5, except the loop isn't necessarily near a resonance of the bicone impedance. This is more of a case of a narrow bandwidth resonance (of the dipole) inserting a loop into a broader band impedance (of a bicone). With further dipole section length, increased eventually to 2 inches, as the difference between the ¼ wavelength lengths of the bicone path 222 and dipole path 222 and 226 increases, this loop increases in size and moves down in frequency along the locus in direction 507, starting to separate itself and its band from the tight broadband bicone impedance in area 505. The tightness and bandwidth in area 505 reduces back to about what it was for the bicone by itself. Traces 502 and 522 show this situation, with the loop 511. The separation of the ¼ wavelength resonant length frequency 509 and its band of the dipole from the broadband area 505 of the bicone can allow a significant lowering of the cut in frequency 503 of the bicone to that of the bicone fed dipole (504) when dipole sections are added to the bicone, as is seen in FIG. 8. With even further lengthening of the dipole sections, the dipole band moves even lower in frequency and a VSWR spike starts to form between the dipole band and bicone band, similar to what is seen in trace 404 of FIG. 6. This eventually leads to formation of a two band antenna.

There continues to be a need for improved performance of antenna systems in all frequency ranges, specifically in the lower frequency ranges of bicone fed antenna systems.

SUMMARY OF THE INVENTION

Accordingly, it is an object of the present invention to extend the low frequency response of a shorted bicone antenna by using a combined bicone and dipole antenna.

An antenna for passing a cable to a second antenna includes shorts positioned along a circumferential perimeter of the antenna, a bicone of first and second oppositely directed bicone sections consisting of conductive cone sections energized at respective apices and opening along an antenna axis, first and second dipole sections, where the first dipole section is joined together with and extending from the first cone section to the circumferential perimeter of the antenna, and where the second dipole section is joined together with and extending from the second cone section to the circumferential perimeter of the antenna.

Other objects and advantages of the present invention will become apparent from the following description, figures and claims.

DESCRIPTION OF THE PREFERRED EMBODIMENT(S)

Figure 1:
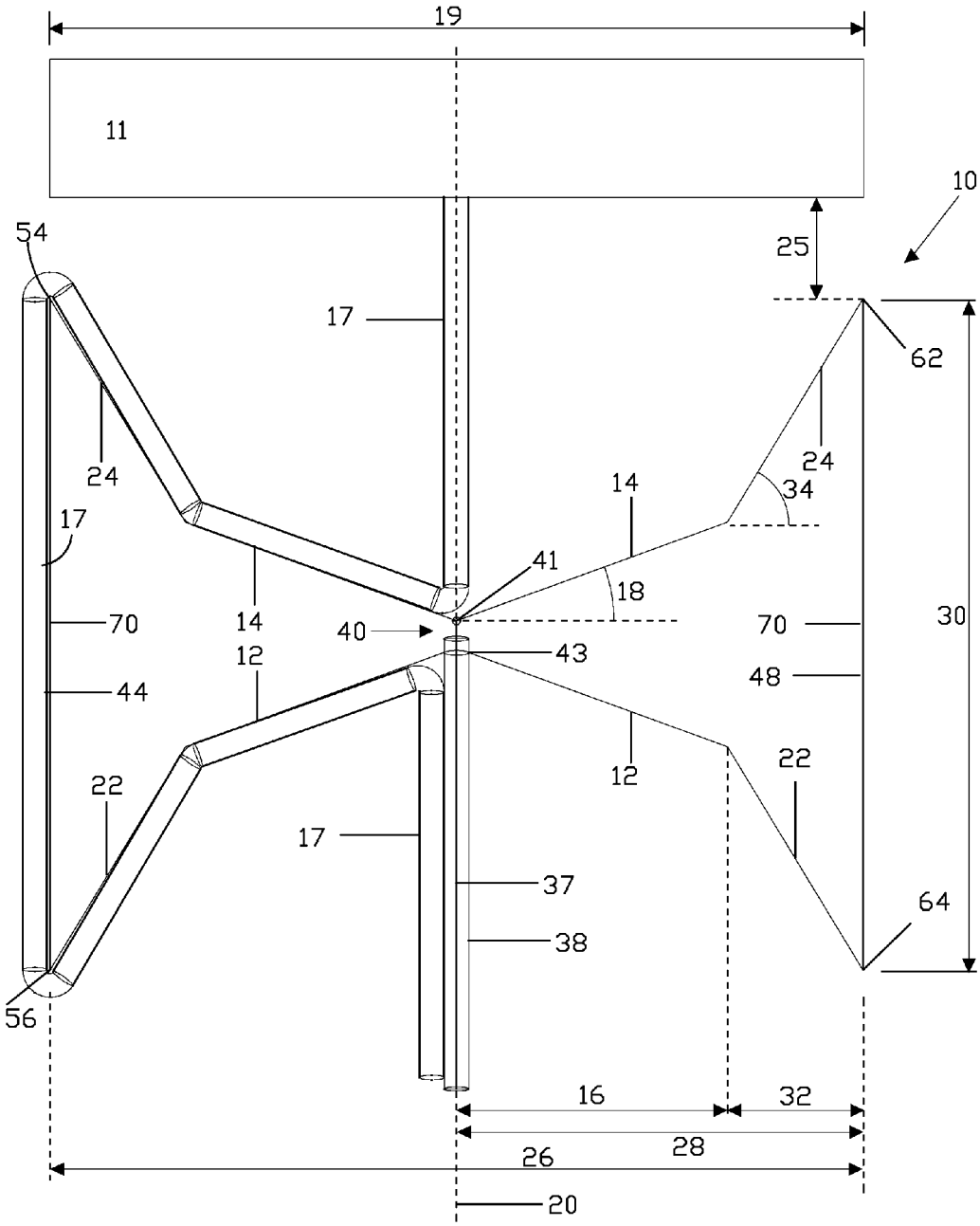
FIG. 1 is a two dimensional side view schematic of an inductively shorted bicone fed tapered dipole antenna through two of its four shorts, showing the cable path to an arbitrary second antenna above the inductively shorted bicone fed tapered dipole antenna, in accordance with features of the invention.

In order to improve the low frequency response of the antenna, the cut-in frequency of the shorted bicone should be lowered. A simple solution is to scale the antenna size according to the new cut-in frequency, which would increase its diameter and height. However, the diameter cannot be increased since it is fixed at the maximum inner diameter of the antenna's radome, which is defined as a physical structure which covers and protects the antenna. The radome can take on any shape and for the preferred embodiment it has a cylindrical shape with a curved inner surface and a hemispherical cap.

Even with a fixed diameter, the height could not be increased since an increase in height would increase the feed angle which would cause the antenna characteristic impedance $Z_0$ to increase causing a mismatch. A solution is to convert the bicone part of the antenna into a bicone fed dipole of larger height with factors as noted below. The increased height of the overall larger antenna results in its cut-in frequency being lowered.

The dipole section of the antenna could not be a vertical cylinder of pitch angle of 90 degrees (relative to a horizontal plane perpendicular to the antenna axis, which is the horizon when the antenna axis is mounted vertically), since the shorts can only touch the top and bottom of the antenna which would be at the top and bottom of the dipole sections. A vertical cylinder would touch the shorts all along its length, shorting out and essentially negating the dipole section as being part of the antenna. Thus the pitch angle of the dipole sections is set to less than 90 degrees, resulting in the dipole section being like a bicone of high pitch angle. The angle has to be appreciably less than 90 degrees so that some separation exists between the shorts and the dipole. If the shorts are too close to the dipole sections, a transmission line starts to form between the shorts and dipole sections, which then decreases bandwidth. Thus for shorts to appear reasonably disconnected from the dipole, not only must they be physically disconnected from the dipole (except for their connection points at the top and bottom of the dipole), but a reasonable distance must separate the shorts and the dipole.

To maintain an average pitch angle roughly equal to that of the original antenna for the same characteristic impedance $Z_0$ of the original antenna, the pitch angle of the bicone section of the antenna is decreased from the original 30 degrees while the pitch angle of the dipole section is increased from 30 degrees.

To ensure a smooth taper from the feed point to the ends of the antenna, the pitch angle of the bicone section is made less than that of the dipole section. The radial width of the bicone section is set at ⅔ of the total antenna radius, and the radial width of the dipole section is set at ⅓ of the total antenna radius. This approximates a continuous smooth curve between the feed point and the antenna ends required for minimum reflections for a fat dipole.

To maintain the properties of the bicone to as low a frequency as possible, such as a low flat VSWR above cut-in and a constant $Z_0$, the feed area of the antenna is made with a bicone having a diameter as large as possible. This diameter is determined by the pitch angle of the dipole sections.

Figure 2A:
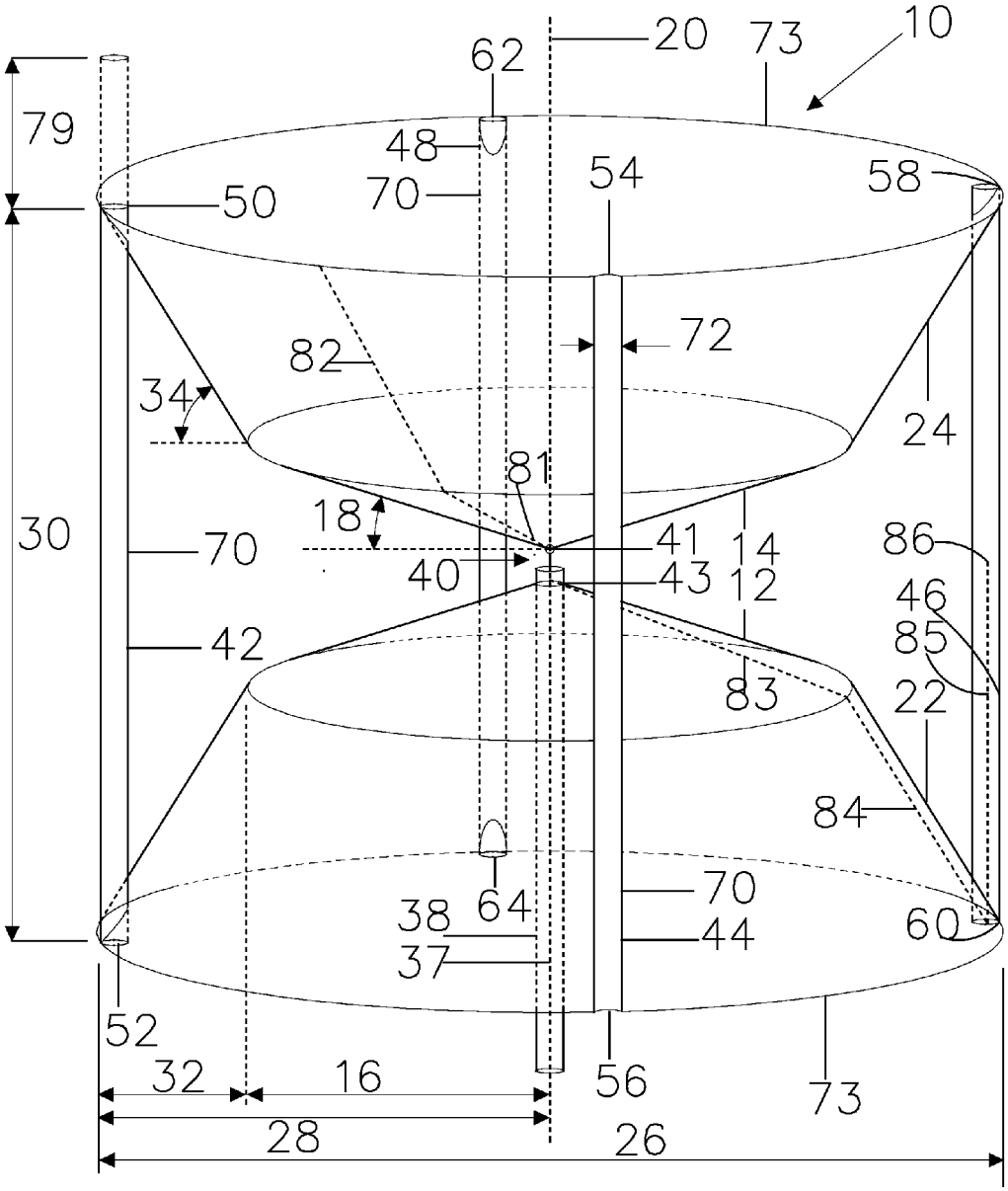
FIG. 2A is a diagrammatic side view of an inductively shorted bicone fed tapered dipole antenna structured in accordance with features of the invention.
Figure 2B:
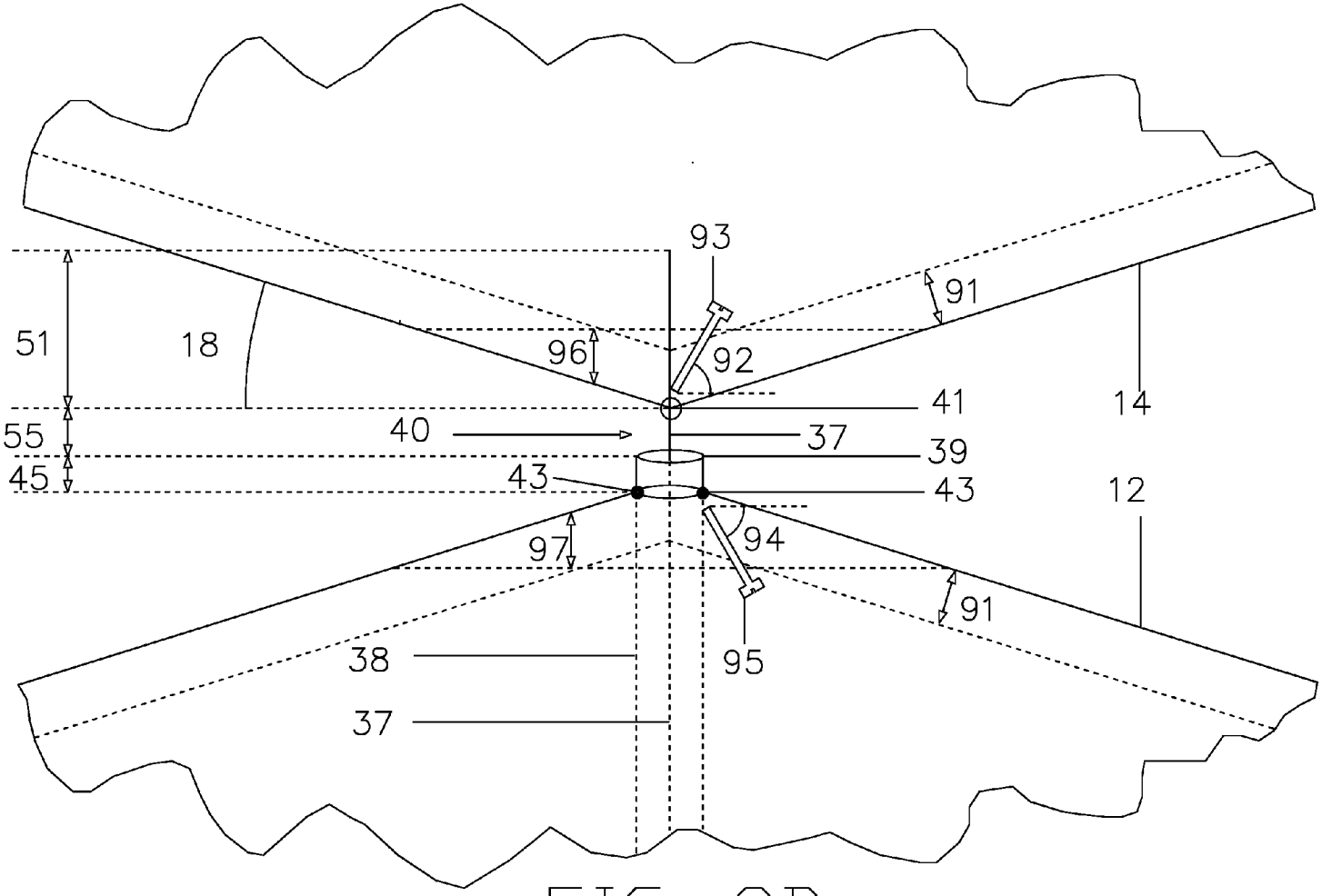
FIG. 2B is an exploded cutout view of the feed section of the antenna of FIG. 2A.

The resultant modified bicone fed dipole antenna 10 includes an antenna axis 20, a width or diameter 26, an antenna radius 28, and an antenna height 30 as shown in FIGS. 1, 2A and 2B. The antenna is made of a bicone section and a dipole section joined together.

The bicone section includes bottom cone section 12 and top cone section 14. Cone sections 12 and 14 each have an equal cone radius 16. Each cone section has a same pitch angle 18, also referred to as a half feed angle between the cones and the horizon. The radial length of a bicone section is 81 or 83.

The modified dipole sections, having pitch angles less than a normal 90 degrees, include a bottom dipole section 22 and a top dipole section 24. Dipole sections 22 and 24 occupy the outer radial section 32 of the antenna's full radius 28. The diameter 26 of the antenna 10 is the diameter of the bottom of dipole section 22 and the top of dipole section 24. The height 30 of the antenna 10 is the distance between the bottom of section 22 and the top of section 24. Each modified dipole section can be looked upon as a bicone of high pitch angle and whose cone tips have been cut off. The angle between each dipole section and the horizon is the pitch angle 34. The radial length of a dipole section is 82 or 84.

The antenna 10 is fed at feed point 40 between the apexes of the bicone sections 12, 14 with coaxial cable 38 (0.141" semi-rigid). At the feed point 40, the outer conductor 39 of the cable 38 penetrates through a hole (not shown) in the center of bottom cone 12 and is connected, e.g. with solder, to the bottom cone 12 at point 43. Alternatively, if the bottom bicone section 12 is thick (91) enough, or if the area at the apex of the bicone section is built up enough to be thick enough (96), a small hole (not shown) can be tapped into the section at an angle 94 to intersect with the outer conductor hole, to allow placement of a screw 95 in the hole that is used to press outer conductor 39 against the inside of its hole in the lower bicone section. The outer conductor's end may stop at point 43, or continue in the vertical direction a short distance 45 past point 43 as shown in FIG. 2B. Also at the feed point the inner conductor 37 of the cable 38 extends a short vertical distance 55 past the end of the cable, and is connected to the top cone 14 of the bicone section 14 at point 41. Connection can be made by allowing the inner conductor 37 to pass through a hole (not shown) in the cone at point 41 a short distance 51 and then soldering the conductor in the hole. Alternatively, if the upper bicone section 14 is thick (91) enough, or if the area at the apex of the bicone section is built up enough to be thick enough (97), a small hole (not shown) can be tapped into the section at an angle 92 to intersect with the inner conductor hole, to allow placement of a small screw 92 in the hole that is used to press inner conductor 37 against the inside of its hole in the upper bicone section. Normally, distances 45 and 55 in FIG. 2B are made as short as possible. Four inductive shorts 42, 44, 46 and 48 made initially of lengths of 0.141" semi rigid coaxial cables 70 are connected with their outer conductors to the extreme ends of the dipole sections of the antenna as shown in FIGS. 1 and 2A and indicated in TABLE 3 below. Connection is made by drilling holes in the dipole section to allow the shorts' cylinders to pass through and then by bonding by solder or weld the outside of the shorts' cylinders to the surface of the dipole section.

TABLE 3

| Inductive Short | Top Dipole Section Connection Point | Bottom Dipole Section Connection Point |
|---|---|---|
| 42 | 50 | 52 |
| 44 | 54 | 56 |
| 46 | 58 | 60 |
| 48 | 62 | 64 |

The connection points not only provide electrical contact, they also provide physical connection to the shorts to allow the shorts to physically support and separate the two sections of the antenna. The four inductive shorts are preferably spaced symmetrically about the circumference of the antenna. At least one of the coaxial cables 70 is cut in half and one of the outer conductor halves, the cable center conductor, and the cable dielectric are removed so as to hollow out the cable and allow it to act as a passageway. This allows at least one feed cable 17 for another antenna 11 (see FIG. 1) above antenna 10 to be passed by the bicone fed dipole antenna 10 without effecting the RF (radio frequency) impedance or patterns of the bicone fed dipole antenna 10.

FIG. 1 shows the feed cable 17 snakes up alongside feed cable 38, down the outside of the lower bicone and dipole sections 12 and 22, up through the hollow inductive short 44, down the outside of the upper dipole and bicone sections 24 and 14, and up along the antenna axis 20 to another antenna 11 above the bicone fed dipole. More cables can be passed by the bicone by using the other inductive shorts. Note that coaxial cable need not be used for the inductive shorts since from an RF viewpoint, only the outside of the outer conductor of a coaxial cable short is being used as the short. Stronger solid metal rods of the same diameter can be used for the inductive shorts that aren't bypassing cables. A hollow rod or half of a hollow rod of the same diameter can be used for the inductive shorts that bypass cables.

Originally, the bypass cable 17 was solid and was to be used as a short across the antenna, to allow it to use itself to pass the antenna. The outside of the outer conductor of the section of cable that bypasses the antenna between the extreme ends of the dipole sections, e.g. between points 56 and 54, was to be the short. However it is cumbersome to bend a solid cable around the ends of the dipole sections while also requiring the cable to be physically connected to the ends of the dipole sections. It is easier instead to make the short as a hollow tube and pass a looser, flexible, independent cable through the tube and pass the antenna. This also simplifies the antenna since the bypass cable, which belongs to the other antenna, is not physically bonded to the antenna.

It can be cumbersome forcing a cable through a hollow tube. Also a cable already with connectors at both ends would require removal of one the connectors before placing the cable into the tube. For ease, the tube can be cut symmetrically along it axis to make 2 half hollow tubes and use one as the short. The cable then is simply laid in the hollow of the half tube and held in place by wrapping tape around the half tube and cable over the full length of the short. To reduce any possibility of the antenna seeing the cable RF-wise, the opened hollow side of the tube is faced radial away from the axis of the antenna. To fully hide the cable, the tape can be conductive, although this was found to be unnecessary.

Alternately, a flexible cable can follow the path of a solid short by simply taping it to the short along its length. For most applications, the cable will be close enough to the short so RF-wise it will more or less not be seen by the antenna, and the increased cross sectional area of the resultant short will change the antenna impedance only a small amount. To fully hide the cable, a conductive tape can be wrapped around the short and cable over the full length of the short.

The dimensions associated with the above antenna 10 depend on minimizing coupling between the antenna and the surface of the upper dipole section 24. If the antenna is close to the bicone fed dipole, its maximum diameter 19 is the bicone fed dipole's diameter 26, in order to minimize coupling to the bicone fed dipole and not block radiation from the bicone fed dipole. Since the shorts provide near zero RF at their connection points to the upper dipole sections, the separation 25 between the two antennas can be smaller than the case where the bicone fed dipole is open with no shorts. To minimize coupling, this distance should be a minimum of roughly 1/20th of the bicone fed dipole's diameter 26.

The dimensions of the antenna 10 are shown in TABLE 4.

TABLE 4

| DIMENSION | VALUE |
|---|---|
| Antenna diameter 26 | 4.75" |
| Radius 16 of bicone sections 12, 14 | (2/3) * 4.75/2" |
| Radial lengths 83, 81 of bicone sections 12, 14 | 1.685" |
| Part 32 of the antenna radius 28 occupied by dipole sections 22, 24 | (1/3) * 4.75/2" |
| Radial lengths 84, 82 of dipole sections 22, 24 | 1.525" |
| Half feed angle 18 or pitch of bicone sections 12, 14 | 90 − 70 = 20 degrees |
| Height of a bicone dipole section 12 and 22, and 14 and 24 | 1.88" |
| Feed point 40 separation, distance 45 + distance 55 | 0 to 3/4" |
| Antenna height and minimum short height 30 | 2 * 1.88" + feed point separation |
| Diameter 72 of shorts | 0.141", from 0.141" diameter semi-rigid coaxial cable |

In practice, its sections and shorts can be milled out of a light, good conducting metal such as aluminum. For ease of fabrication, its 0.141" diameter semi-rigid feed cable can be held in place to ensure connection to the sections with screws 93 and 95, but bonding with solder, e.g., is preferred because it enables a better connection.

Measurements

Measured impedances and cut-in frequencies of the antenna 10 before and after addition of shorts are shown in TABLE 5. Initial antennas used a tapered transmission line balun instead of coaxial feed cable 38 to feed the antenna, and used number 14 wire instead of 0.141 inch cable for the shorts. A tapered transmission line balun working down to 300 MHz was used to measure the open version of the antenna 10, since feeding the antenna with a coaxial cable would allow the outside of the cable to become part of the antenna below its cut-in frequency of approximately 700 MHz. However, even the balun below 300 MHz allowed currents to flow down the outside of its feed cable, which inserts a resonance/antiresonance loop 603 (on FIG. 9) into the antenna impedance when the balun and cable becomes of a resonant length. External feed cable currents are less of a problem with the shorted cases of the antenna, since there is a close to a short across the antenna aperture below cut-in and there is less incentive for currents to flow down a higher impedance feed cable.

TABLE 5

| ANTENNA TERMINATION | SHORT TYPE | FEED METHOD | VSWR = 3:1 Cut-in Frequency (MHz) | Impedance and VSWR FIGS. |
|---|---|---|---|---|
| open | — | balun | 660 | 9, 11 (trace 621) |
| short | no. 14 wire | balun | 700 | |
| short | no. 14 wire | coax | 700 | |
| short | 0.141 diameter coaxial cable | coax | 720 | 10, 11 (trace 622) |

Switching from a balun feed to a coaxial cable feed showed expected similar impedances for the shorted antenna with number 14 wire shorts. Switching to the final 0.141 inch diameter shorts showed a little more loss of bandwidth and a slight increase in cut-in frequency.

Overall, using a VSWR value of 3:1 to define the location of the cut-in frequency, the cut-ins of the prior and present antennas are shown in TABLE 6 and the objective of lowering the cut-in frequency with a shorted bicone fed dipole was met.

TABLE 6

| Antenna | VSWR = 3:1 Cut-in Frequency (MHz) |
|---|---|
| Shorted bicone | 900 |
| Shorted bicone fed dipole | 720 |

Figure 3:
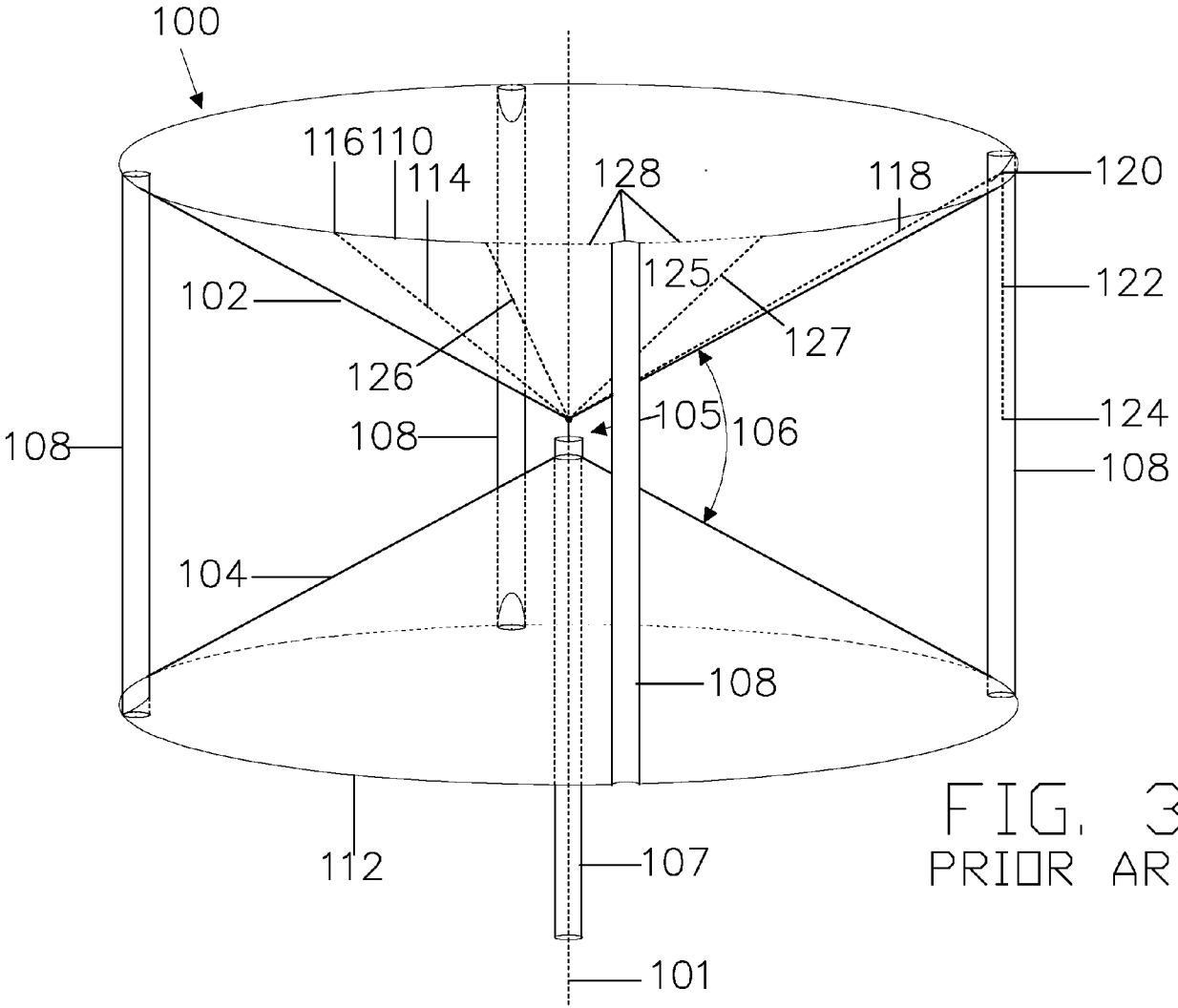
FIG. 3 PRIOR ART
FIG. 3 is a side view diagram of a prior art shorted bicone antenna.
Figure 4:
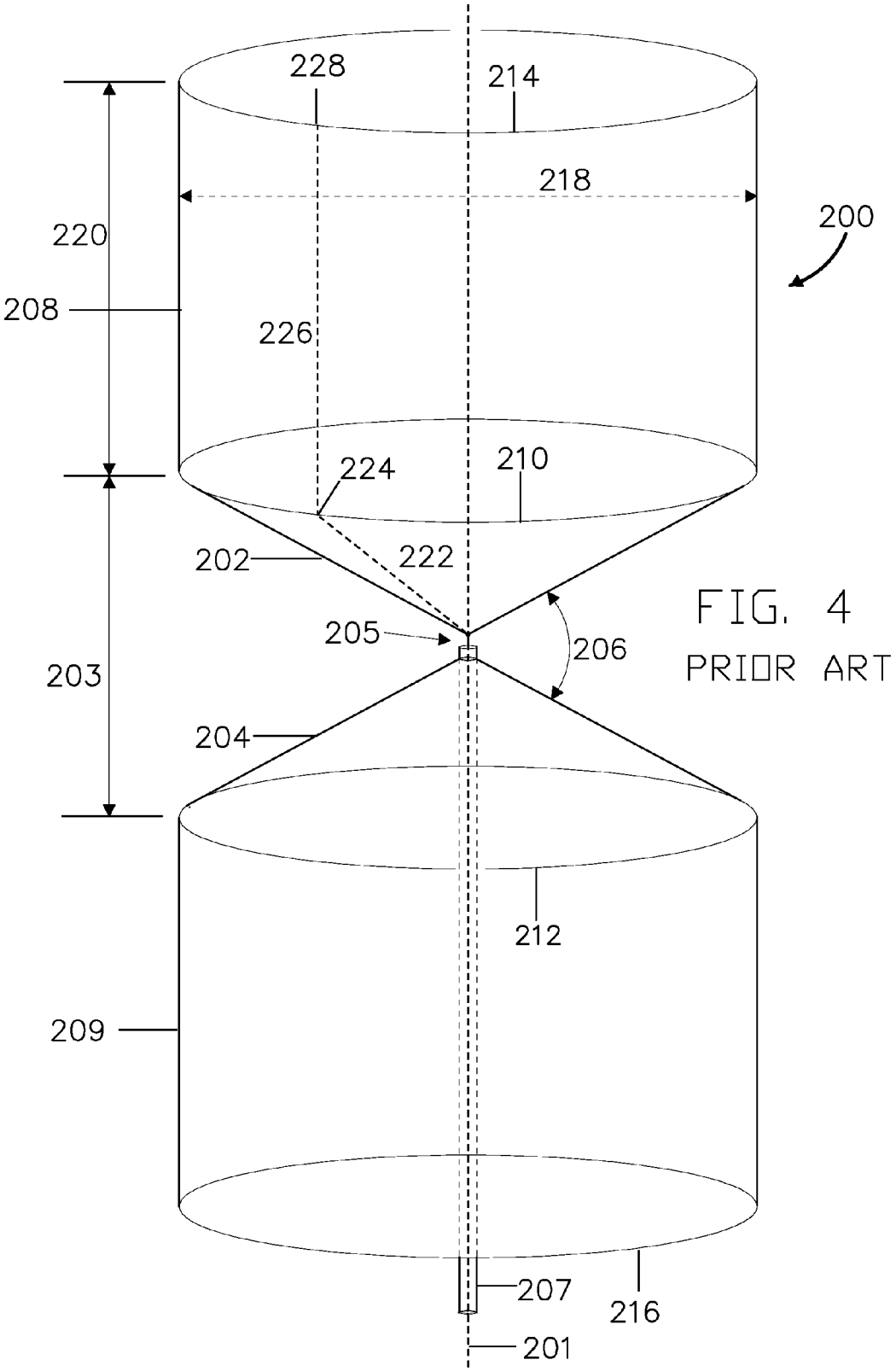
FIG. 4 PRIOR ART
FIG. 4 is a diagram of a prior art bicone fed dipole antenna.

The antenna, being roughly the parallel combination of the open and shorted sections of a bicone fed dipole, has three possible resonance components. These are the sections of the antenna about the following paths. The sections (not shown) occupy roughly 45 degrees of antenna circumference about a path, and are similar to, e.g. shorted section 125 of the shorted bicone of FIG. 3.

One open path is example radial path 81 along the center of an open part of a bicone section 14 from its apex to its circumferential end.

A second open path is example radial path 81 along the center of an open part of bicone section 14 from its apex to its circumferential end and its continuation 82 on the center of an a open part of dipole section 24 to an open end of the antenna.

A third shorted path is example radial path 83 along the center of a shorted part of bicone section 12 from its apex to its circumferential end and its continuation 84 on the center of a shorted part of dipole section 22 to an shorted end 60 of the antenna and its continuation 85 on short 46 and ending at the center 86 of the short.

Figure 9:
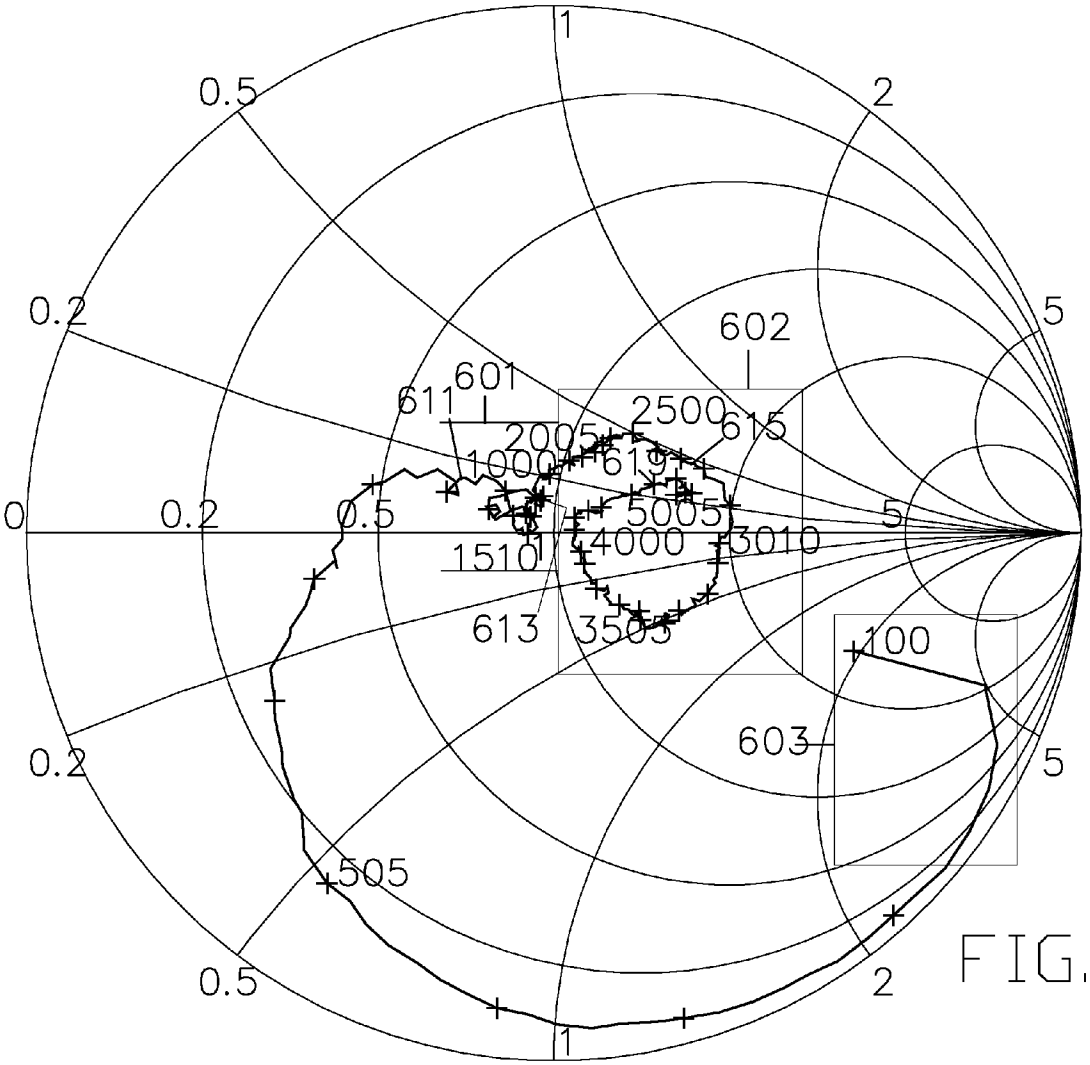
FIG. 9 is a Smith Chart impedance of the inductively shorted bicone fed tapered dipole antenna without the shorts.
Figure 10:
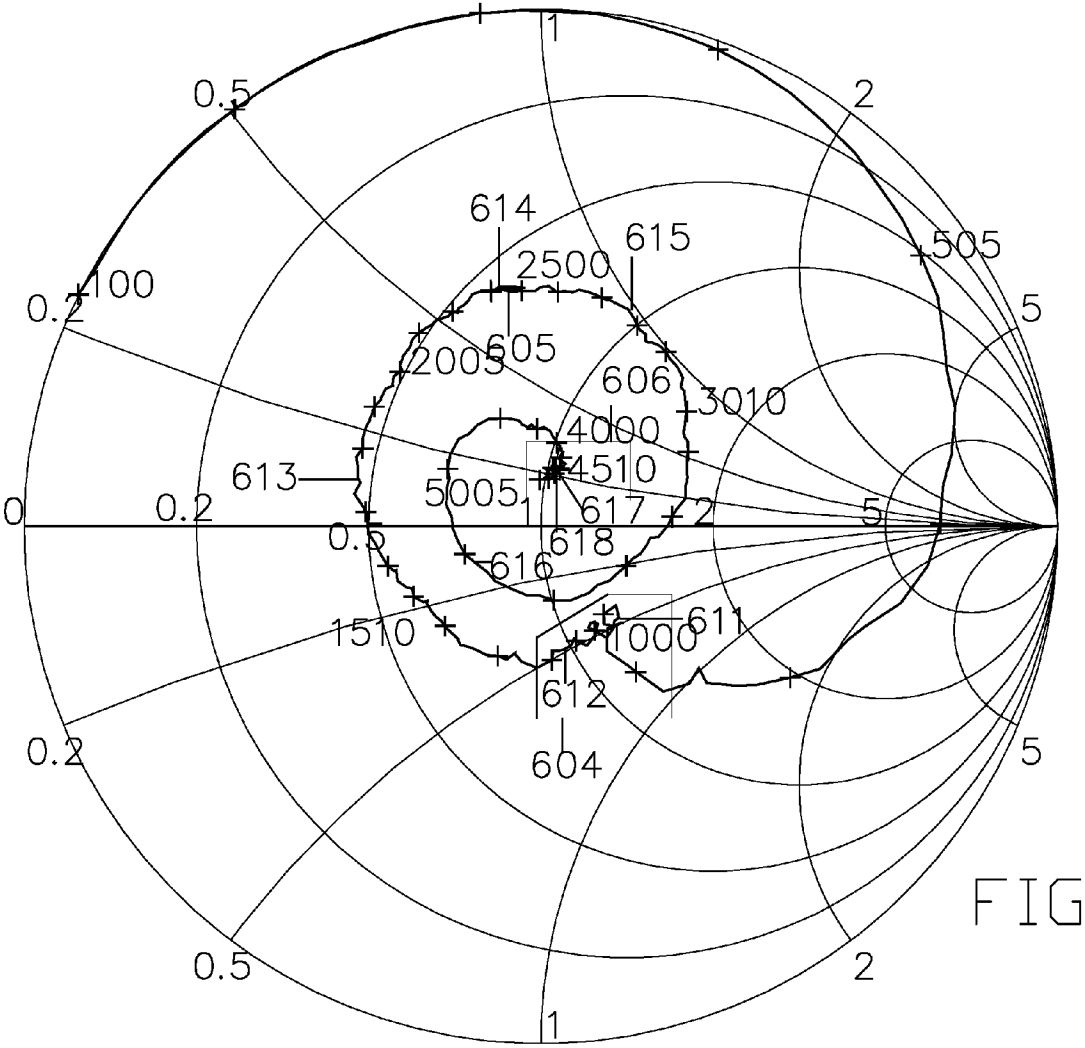
FIG. 10 is a Smith Chart impedance of the inductively shorted bicone fed tapered dipole antenna.

The table below shows possible narrow band resonance lengths and frequencies of the various radial paths along the bicone and dipole sections 12, 14 and 22, 24, and shorts 70 of FIG. 2A of the antenna for the cases when the antenna is open and shorted, and any resonance/antiresonance loops between these frequencies observed in the impedance of the antenna, in respective FIGS. 9 and 10. The original broadband resonances of the open bicone by itself were not measured, but are lower in frequency than those of the narrow band cases. Corresponding VSWR's are shown as respective traces 621 and 622 on FIG. 11.

TABLE 7

| | Path type and length (wavelengths) | | | | |
|---|---|---|---|---|---|
| Resonant frequency of path or center frequency of loop (MHz) | Open bicone path 81 | Open dipole path of bicone section path 81 and dipole section path 82 (open case) | Shorted bicone path 83 and dipole path 84, and shorted path 85 (shorted case) | Resonance/ antiresonance loop | Part number |
| 920 | | .25 | | | 611 |
| 1050 | | | | tight loop (shorted case) | 604 |
| roughly 1500 | | | | wide tight loop (open case) | 601 |
| 1160 | | | .5 | | 612 |
| 1752 | .25 | | | | 613 |
| 2320 | | | 1 | | 614 |
| 2450 | | | | small tight loop (shorted case) | 605 |
| 2759 | | .75 | | | 615 |
| 3431 | | | 1.5 | | 616 |
| 4599 | | 1.25 | | | 617 |
| roughly 4600 | | | | a few tight loops (shorted case) | 606 |
| 4641 | | | 2 | | 618 |
| 5257 | .5 | | | | 619 |

For the open case of the antenna, the impedance is that of the bicone fed dipole. Referring to FIG. 9, area 601 of the impedance locus of the antenna is the dipole impedance with the effect of the dipole length of the radial bicone section length 81 plus the dipole section length 82 of the antenna adding its comparatively narrow band resonance frequency 611 of 920 MHz to the impedance as a tight resonance antiresonance loop between resonance 611 and a possible narrowband resonance 613 of 1752 MHz of the radial bicone length 81 of the bicone section. The actual resonance of the bicone section is broadband and lower in frequency. A few additional tiny loops seen within the main loop are due to slight asymmetries in the radial lengths 81 of the bicone sections 12, 14 and 82 of the dipole sections 22, 24, about the antenna axis, due to the antenna being constructed of soldered copper tape on Mylar sheet. Referring to FIG. 9, area 602 of the impedance locus shows mostly the bicone impedance of the antenna when it is above cut in and broadband, being of the radial bicone section length 81.

For the shorted case of the antenna with number 14 wire shorts, the short wraps the low frequency part of the impedance locus from an open to a short at 0 Hz, as was done with the shorted bicone of U.S. Pat. No. 6,268,834. However, the addition of the first half wavelength shorted resonance 612 of 1160 MHz of example path 83, 84, 85 to the impedance spreads out the locus for some loss of bandwidth above the area of the resonance and up to 4000 MHz, as opposed to tightening it for more bandwidth. To be more specific, the tight part of the impedance locus area 601 due to the open dipole resonance 611 in the bicone impedance of the open case of the antenna, with the introduction of shorted resonance 612 of the shorted case of the antenna, has been reduced in size to a tight part of the impedance locus between resonance 611 and resonance 612 with a significant part of the broadband bicone impedance locus above resonance's 612 frequency spreading out and untightening for a loss of bandwidth. There is mainly broadbanding due to overlapping of the bands of the resonances of the open (611) and shorted (612) bicone dipole circumferential sections about example paths 81, 82 and 83, 84, 85 and little from the original broadband impedance of the bicone section about example path 81, shown mainly in area 602 and starting roughly around the open ¼ wavelength narrowband resonant frequency 613 of the bicone.

Figure 5:
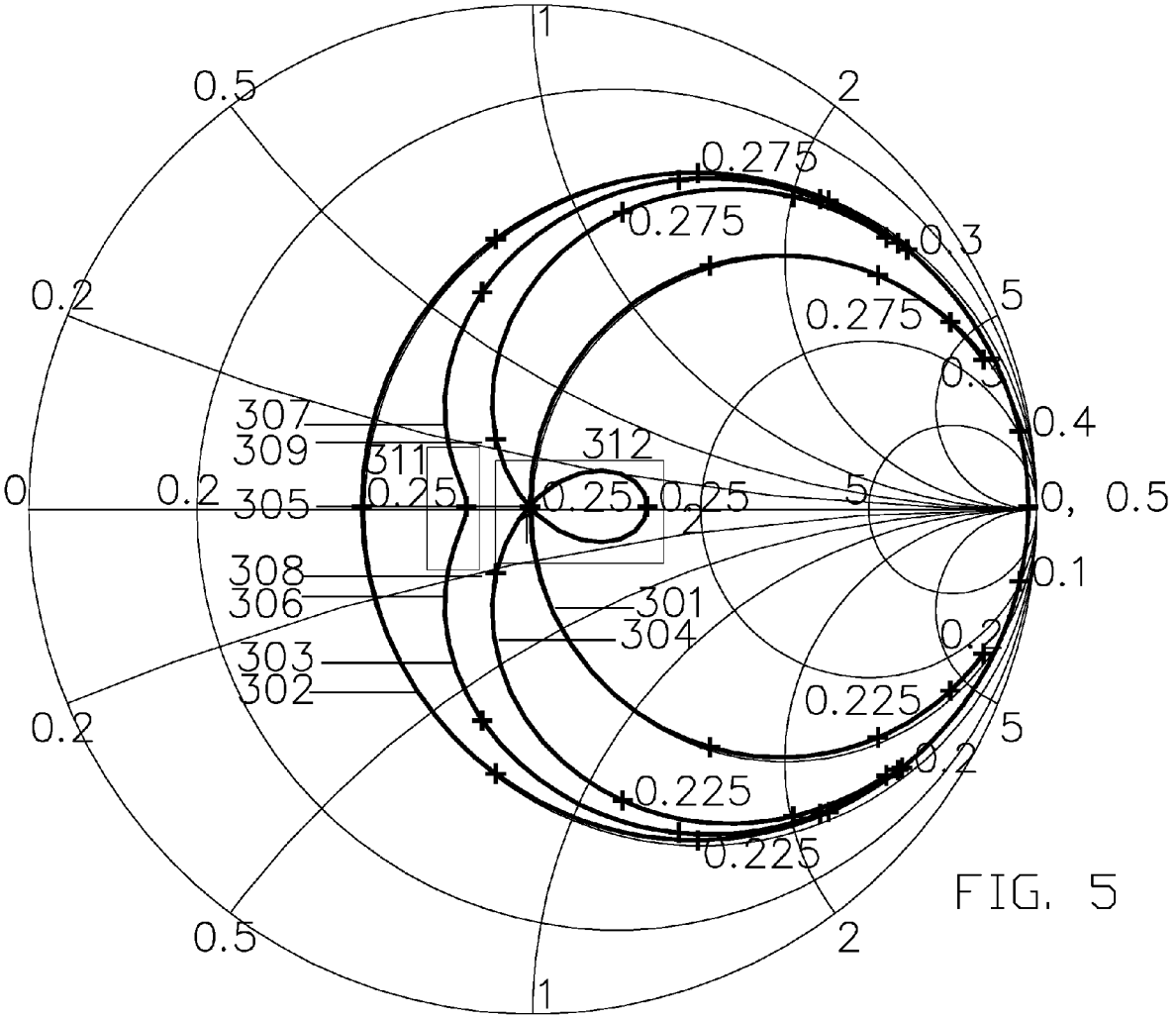
FIG. 5 is the combined impedances of two resonances whose bands overlap to various degrees.
Figure 6:
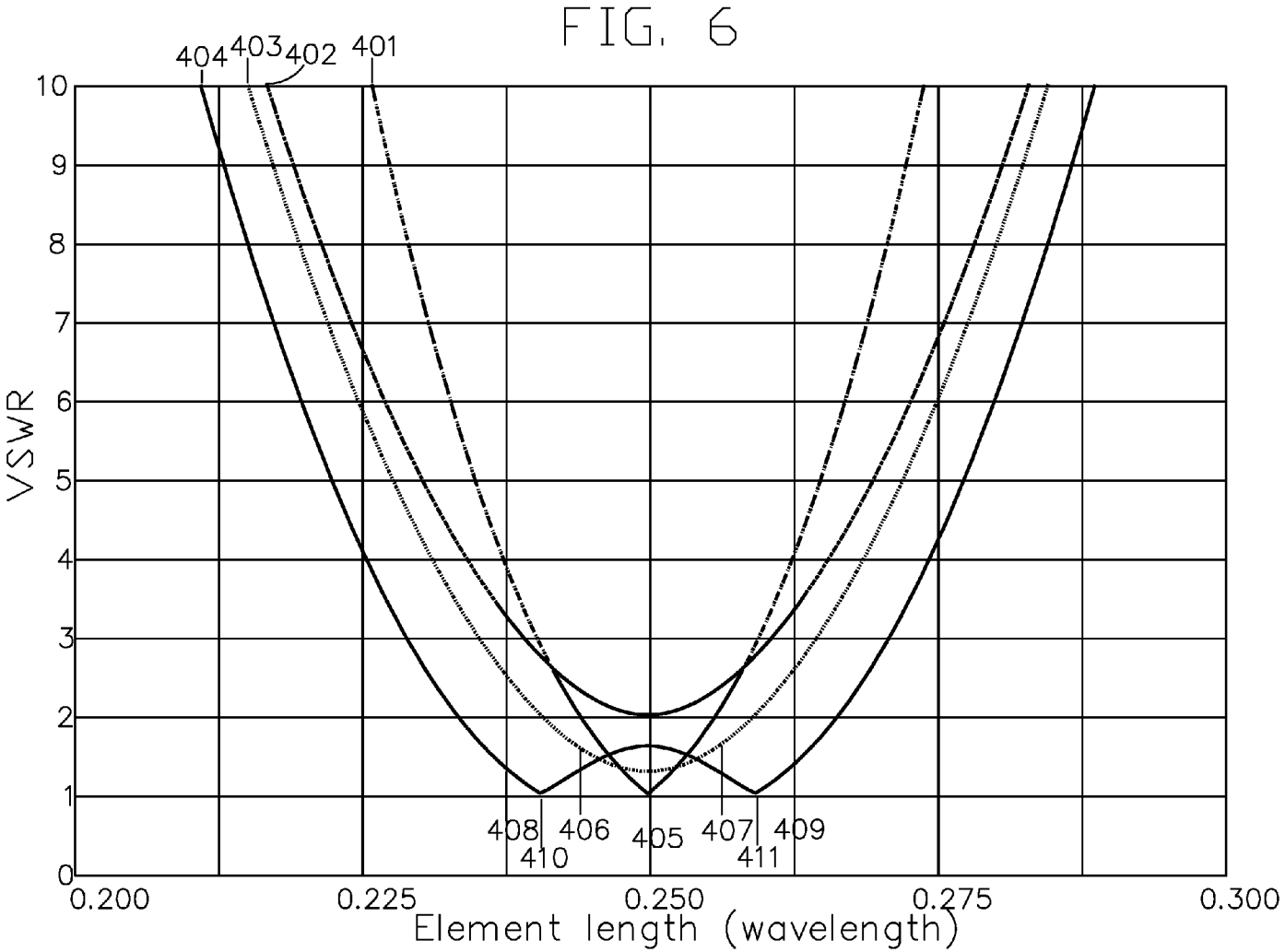
FIG. 6 is the VSWR's of the impedances of FIG. 5.
Figure 7:
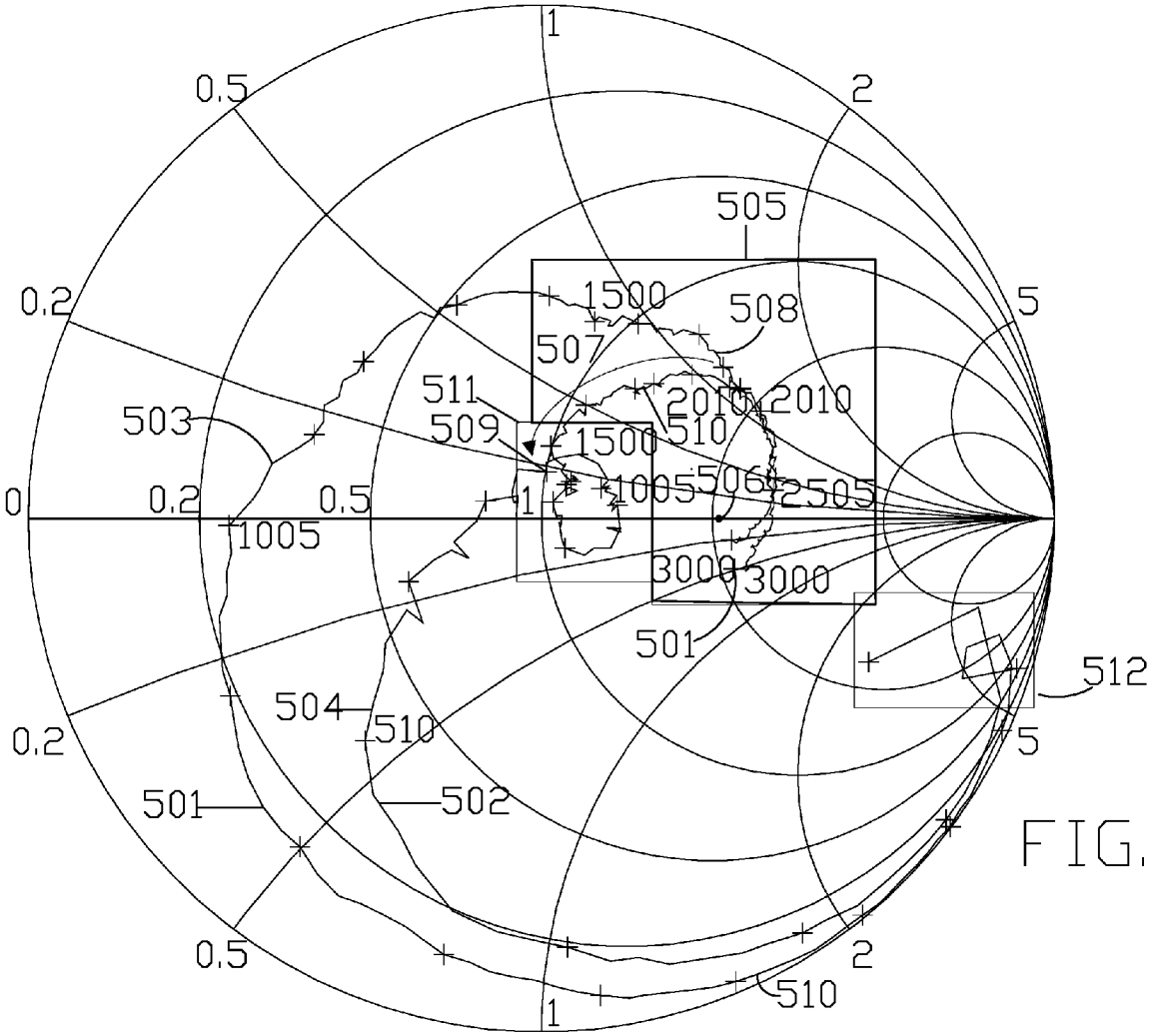
FIG. 7 are Smith Chart impedances of an example bicone fed dipole antenna before and after addition of its dipole section.
Figure 8:
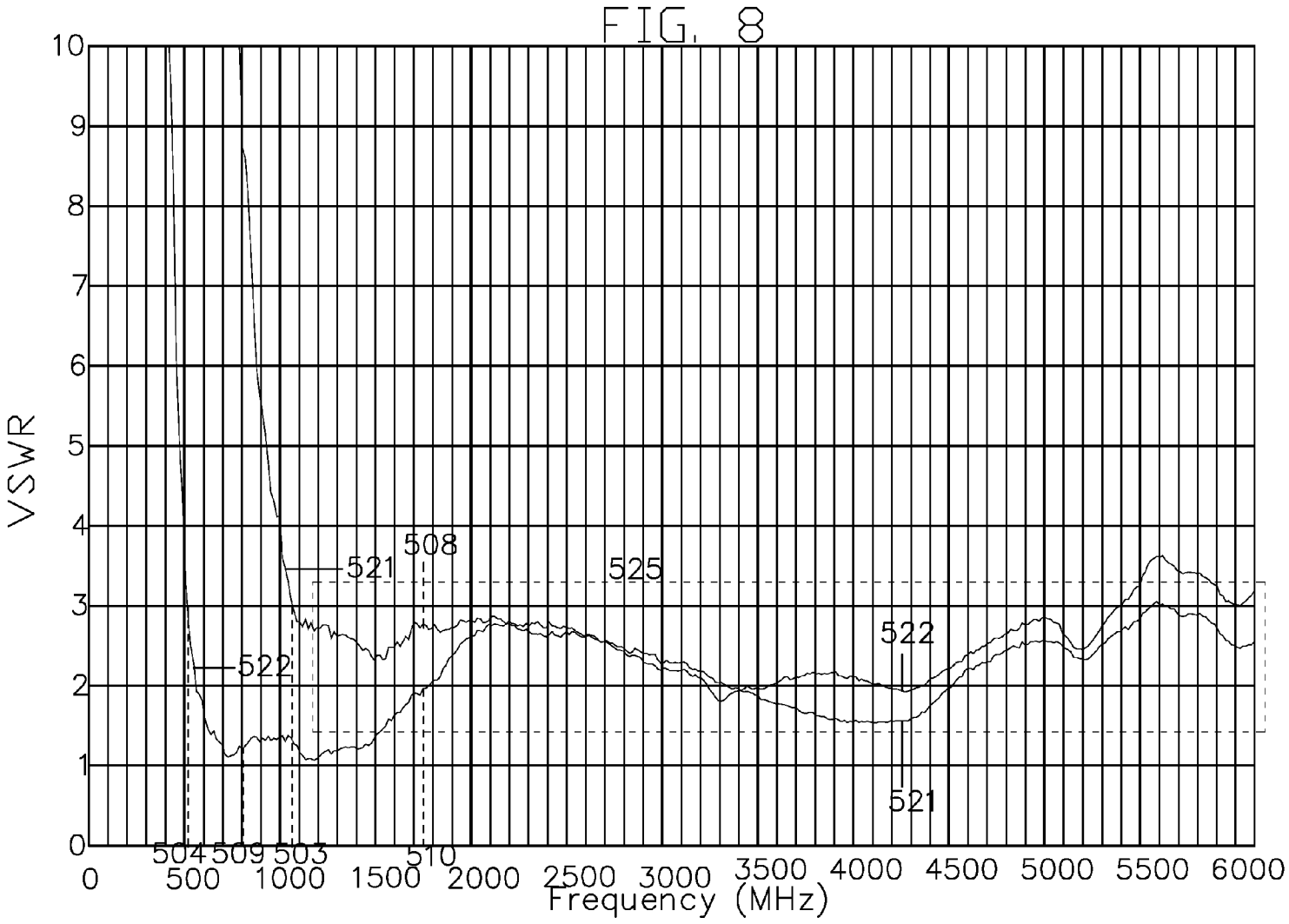
FIG. 8 is the VSWR's of the impedances of FIG. 7.
Figure 11:
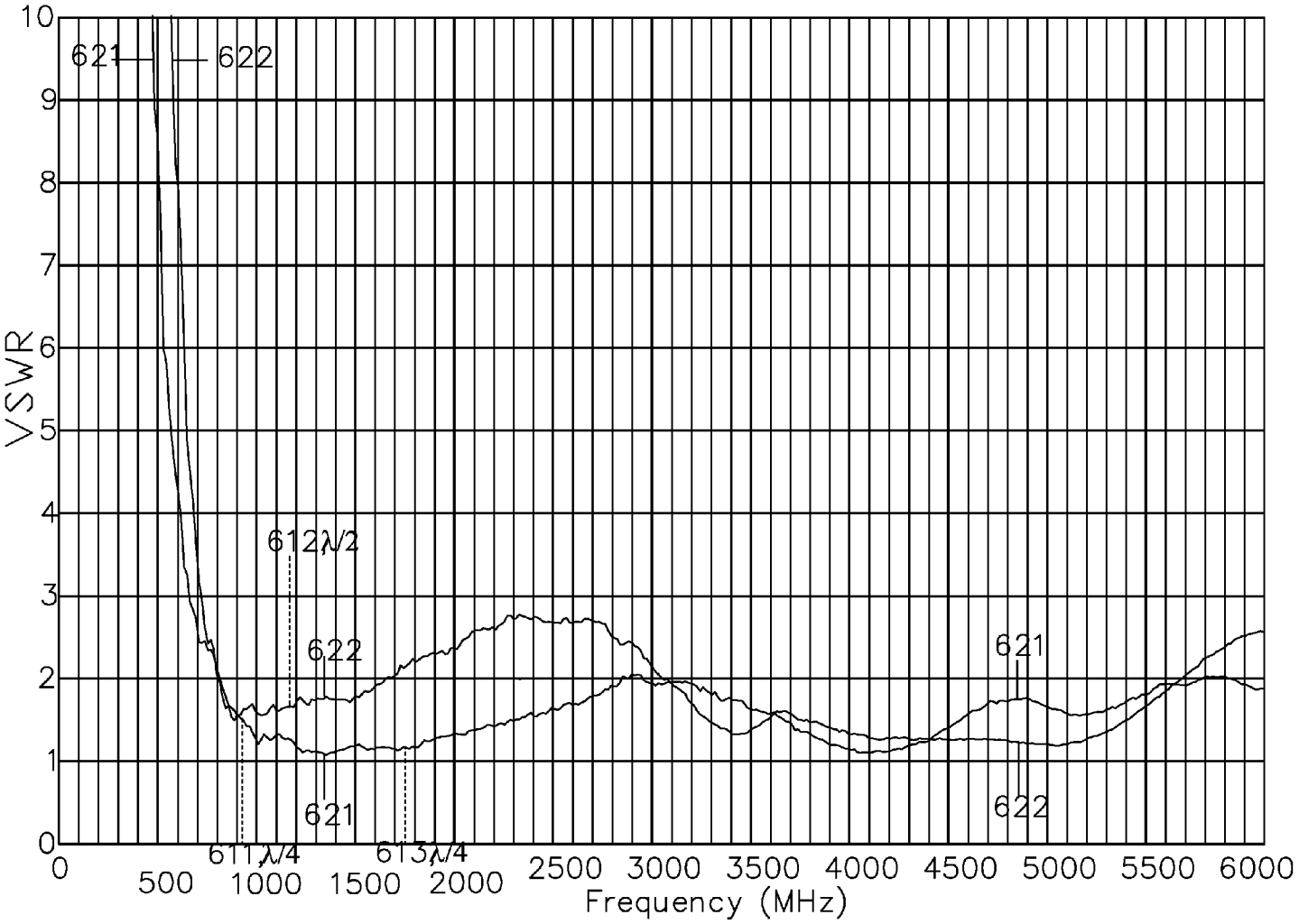
FIG. 11 is the VSWR's of the impedances of FIGS. 9 and 10.

The spreading may be explained partially by at least one fact that the added shorted resonance 611 at 1160 MHz is almost on top of one of the existing resonances of the antenna (as seen in FIG. 11), that being the dipole quarter wavelength resonance 611 of the bicone dipole sections' length 81, 82 of 920 MHz. The principle of band overlapping for increased bandwidth and/or match requires that the two bands to be combined are adjacent to and separated some from each other, and not near or at coincidence with each other. Impedance locus area 601 is already very broadband and needs no other resonances inserted into it and possibly disturbing it. As an example of how a combined resonances' impedance can be disturbed, the extreme case of coincidence of two ideal parallel combined resonances is shown as trace 302 in FIG. 5. At resonance, its impedance is ½ of that of the single resonance of trace 301, resulting in its reflection coefficient magnitude being significantly more than 0. A more significant fact that may explain spreading is that once the open bicone fed dipole is shorted, the bicone is no longer fully open but instead is connected to and radiates into a dipole section that is partially shorted. Other factors are present, including the fact that the resonances are not entirely independent of each other and the resonances may have been rotated off of the real axis of the Smith Chart.

At frequencies above resonance 613, a few extra small loops and continued locus spreading are seen to be inserted when the antenna is shorted. A small loop 605 exists slightly above the one wavelength shorted resonance 614. A few resonances between 4000 MHz and 5000 MHz results in a few added loops in impedance locus area 606. Some of these loops may be due to more impedance sensitivity to asymmetries in the radial path lengths around the antenna axis at higher frequencies of smaller wavelength. Overall the loops are less important for match since the antenna becomes more broadband at higher frequencies.

It may be concluded that the presence of resonances from the shorts actually degrades the bandwidth and match of the antenna because the antenna without shorts is already well matched with large bandwidth. Attempts to improve this with additional resonances are not needed. Removal of the shorts is not possible and thus a method that eliminates their resonances instead would be an improvement. One possibility is to add broadband ferrite core chokes placed about the shorts 70 near their ends 50, 52, 54, 56, 58, 60, 62, 64 to prevent antenna currents from flowing onto the shorts. Some problems with this method are that ferrites have loss and limited bandwidth, and the resulting floating shorts become parasites that may degrade patterns.

Measured patterns of the final shorted antenna were similar to the shorted bicone, subject to higher gains from better matches at lower frequencies, due to the reduced cut-in frequency. At higher frequencies, nulls start to form about shorts as with the shorted bicone.

Tuning

An alternative to ridding the degrading impedance effects of the shorts is to compensate for it. Initially the separation 45 and 55 (feed point separation) of the bicone fed dipole halves of the antenna (12 and 22, and 14 and 24) in the feed region 40 is minimal. The protrusion 45 of the outer conductor of the feed cable above the lower cone can be set at 0, and the extension 55 of the center conductor to the upper cone is minimized to what is practical. However, it was found that some fine tuning of the VSWR could be accomplished at the lower frequencies where the antenna is used for good azimuth patterns by adjusting distance 55 to a value greater than 0. Between 1500 and 3000 MHz a maximum decrease of 1 VSWR was seen when an optimal value of the distance between 0 and ¾ inch was found. This was at the expense of VSWR loss above 4 GHz where patterns are poor. Impedance-wise, the addition of the length of the center conductor adds a small series inductive impedance to the antenna. Smaller impedance changes occur from the changing separation of the bicone fed dipole halves, which changes the capacitance between the two and thus the antenna's characteristic impedance, and the lengthening of the shorts, which increases their inductance some. The length 45 of the cable protrusion can also be adjusted to a value greater than 0 to add a small series inductive impedance to the antenna, but the impedance is appreciably smaller than that obtained from the center conductor length 55, due to the protrusion's much larger diameter. Thus normally length 45 is set practically to zero for practically no inductance.

The procedure described below is followed to allow fine tuning. The hole (not shown) at the tip of the upper bicone section 14 located at 41 through which the inner conductor 37 passes is small enough so the center conductor fits snugly. This ensures electrical contact but also allows the upper bicone fed dipole section 14, 24 to slide on it during adjusting the separation between the bicone fed dipole sections during fine tuning. Once the proper separation is found, the conductor is bonded to the hole with solder. Alternatively, a screw 93 is used to press the conductor firmly in place against the hole sides. The extension length 51 of the center conductor is long enough to ensure there is always a piece of the conductor in the hole as the separation is adjusted. The bottom of the shorts are bonded to the lower dipole section 22 at locations 52, 56, 60 and 64. However, the tops of the shorts at locations 50, 54, 58 and 62 are initially not bonded to their holes in the top dipole section 24. They are allowed to slide in their holes as the section moves up and down when the separation is adjusted. Once the proper separation is found, the shorts are bonded to the section in their holes with solder or weld.

The top of the shorts are initially extended a small distance 79, for example to allow for the up and down movement of the top section. Once the proper separation is found, the shorts are cut level with the top of the section.

To ensure electrical contact between the shorts and the top section during adjustment, an elastic band is wrapped around the 4 shorts to draw them radially inward so they contact the antenna axis side of the holes of the section where they are located. Contact with this side of the hole ensures the shortest shorting path across the feed point 40.

The number of shorts in the above antenna example is four. This number could be varied from one to a large number determined by practicality, with cut-in frequency increasing with the number of shorts. To physically support the antenna pieces of bicone section 12 and dipole section 22, plus bicone section 14 and dipole section 24, at least three shorts are needed. If less are used, nonconductive supports would be used in place of the shorts so that at least three supports, conductive or nonconductive, would be present.

If the antenna is placed in a radome of reasonable thickness and material, little change will occur in the antenna's VSWR. By making the diameter of the antenna wide enough so that it fits closely in a cylindrical radome, its top and bottom edges 73, and its shorts 42, 44, 46 and 48, can press against the inside circumference of the radome to help prevent the radome from radial collapse when the radome and antenna is placed in a high pressure environment. Increasing the thickness and number of shorts would produce further force against the radome, at the expense of increased cut-in frequency. The shorts can also be shaped to the inside curvature of the radome, to allow a smoother application of their force to the radome.

Some loss of bandwidth occurred when the shorts were added to the bicone fed dipole. Thus the geometry may not be optimal. Other values for the pitch angles of the bicone and dipole sections may be possible, along with different ratios of the bicone section radius to the dipole section part of the antenna radius. Only two transitions were used to taper the antenna from a bicone to a dipole. More transitions can be used until eventually a continuously smooth taper exists. Of course, all these variables would change if the antenna is to be matched to a $Z_0$ other than 50 ohms. For a higher $Z_0$, the pitch angle (half feed angle) of the bicone section would be higher.

Longer antennas would work at lower frequencies but the extent of how long the antenna can be, in terms of length to diameter ratio, is unknown. It can be expected that if the antenna is made too long, a two band antenna would result.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An antenna comprising:

a first conical section, having a radial width that is two thirds of the total antenna radius;

a second conical section, having the same dimensions as the first conical section, disposed below the first conical section and oriented on the same axis as the first conical section but in the opposite direction such that the apex of the second conical section is a small axial distance from the apex of the first conical section, wherein both first and second conical sections are energized at their respective apices which serve as the feed point of the antenna;

a first dipole section, having a radial width that is one third of the total antenna radius, joined to and extending from said first conical section, wherein the pitch angle of the first conical section is less than that of the first dipole section;

a second dipole section, having the same dimensions as the first dipole section, joined to and extending from said second conical section, wherein the pitch angle of the second conical section is less than that of the second dipole section; and a plurality of cylindrical rods positioned symmetrically along a circumferential perimeter of the first dipole section and second dipole section wherein one of the plurality of cylindrical rods is an inductive short and each of said plurality of cylindrical rods are connected to the first and second dipole sections such that the connection points serve as physical supports for the entire antenna while the connection points of the cylindrical rod that is an inductive short also serve as electrical contacts.

2. The antenna of claim 1 wherein at least one of said plurality of cylindrical rods is an inductive short and its connection points serve as electrical contacts for the entire antenna.

3. The antenna of claim 2 wherein the at least one of the plurality of cylindrical rods that is an inductive short comprises a solid conductive metal rod, whereby said solid conductive metal rod provides a path along its external surface along which a cable can pass to another antenna.

4. The antenna of claim 2 wherein the at least one of the plurality of cylindrical rods that is an inductive short comprises a hollow conductive metal rod that enables a cable to pass through said hollow conductive metal rod to another antenna.

5. The antenna of claim 1 wherein at least two of the plurality of cylindrical rods are inductive shorts that comprise hollow conductive metal rods that enable at least two cables to pass through each of said at least two hollow conductive metal rods respectively to other antennas.

6. The antenna of claim 1 wherein the plurality of cylindrical rods consist of at least one cylindrical rod that is made of conductive metal and functions as an inductive short and the remainder of the plurality of cylindrical rods are made of dielectric material of the same dimensions as the at least one conductive metal rod.

7. The antenna of claim 1 wherein the plurality of rods provides separation between the first and second conical sections of the antenna.

8. The antenna of claim 1 wherein an impedance of the antenna is 50 ohms.

9. The antenna of claim 1, wherein the respectively joined conical and dipole sections are tapered together with at least two distinct pitch angles.

10. The antenna of claim 1, wherein the respectively joined conical and dipole sections are tapered together smoothly with a continuously changing pitch angle.

11. The antenna of claim 1, wherein said antenna is deployed within a radome having an inside curved surface and wherein the plurality of cylindrical rods are positioned within the inside curved surface of the radome.

12. The antenna of claim 11, wherein the circumferential edges of the first dipole section and of the second dipole section press against the inside curved surface of the radome to provide radial support force to the inside surface of the radome.

13. The antenna of claim 11 wherein the plurality of cylindrical rods are disposed such that they press against the inside curved surface of the radome to provide radial support force to the inside surface of the radome.

14. The antenna of claim 12 wherein the portion of the plurality of cylindrical rods that press against the inside curved surface of the radome are shaped to the inside curved surface of the radome.

15. The antenna of claim 11, further comprising a semi-rigid coaxial cable having an inner and outer conductor that electrically feeds the antenna, wherein the outer conductor penetrates through the center of the second conical section and is connected thereto, wherein the inner conductor extends vertically from the feed point and is connected to the first conical section.

16. The antenna of claim 11, wherein the plurality of cylindrical rods extend a small vertical distance beyond the circumferential end of the first dipole section, to allow changing the length of any of the plurality of cylindrical rods that are inductive shorts and to allow changing the separation between the first and second conical and dipole sections.

17. The antenna of claim 16, wherein the inner conductor extends a small vertical distance above its connection point in the first conical section, to allow changing the length of the center conductor between the semi-rigid coaxial cable and the connection point in the first conical section and to allow changing the separation between the first and second conical sections.

18. The antenna of claim 16, wherein the inner conductor extends from the coaxial cable into the first conical section not more than three quarters of an inch to provide a maximum decrease of one voltage standing wave ratio (VSWR) between 1500 and 3000 MHz.

19. The antenna of claim 1 wherein broadband ferrite core chokes are placed on the cylindrical rod that functions as an inductive short near its end to prevent antenna currents from flowing onto the cylindrical rod that functions as short and degrading the antenna impedance and match.

* * * * *